US007328926B1

(12) United States Patent
Myers et al.

(10) Patent No.: US 7,328,926 B1
(45) **Date of Patent: *Feb. 12, 2008**

(54) PATIENT SUPPORT SYSTEM FOR MEDICAL TRANSPORT VEHICLES

(76) Inventors: Will J. Myers, 5002 N. Laramie Trail, Rogers, AR (US) 72756; Russell Frieder, 617 ½ De La Vina St., Santa Barbara, CA (US) 93101; Srirangam Kumaresan, 465 Coolbrook La., Goleta, CA (US) 93117; Anthony Sances, Jr., 3202 Campanil Dr., Santa Barbara, CA (US) 93109

( * ) Notice: Subject to any disclaimer, the term of this patent is extended or adjusted under 35 U.S.C. 154(b) by 0 days.

This patent is subject to a terminal disclaimer.

(21) Appl. No.: 11/495,935

(22) Filed: Jul. 28, 2006

(51) Int. Cl.
*A61G 3/02* (2006.01)

(52) U.S. Cl. ..... 296/19; 296/24.38; 5/625; 5/118

(58) Field of Classification Search ..... 296/19, 296/20, 24.38, 186.1; 5/620, 600, 81.1 HS, 5/626, 625, 118; 244/118.6, 137.2
See application file for complete search history.

(56) References Cited

U.S. PATENT DOCUMENTS 3,172,698 A * 3/1965 Stumpp ..... 297/118
3,358,300 A * 12/1967 Smith ..... 5/9.1
3,840,265 A * 10/1974 Stirling et al. ..... 296/19
5,785,277 A * 7/1998 Manning et al. ..... 244/137.2
5,813,629 A * 9/1998 Cabrera ..... 244/118.6
6,029,750 A * 2/2000 Carrier ..... 169/52
7,028,351 B1 * 4/2006 Frieder et al. ..... 5/118
7,188,880 B1 * 3/2007 Frieder et al. ..... 296/20

FOREIGN PATENT DOCUMENTS

FR 2481110 * 4/1980

* cited by examiner

*Primary Examiner*—Jason S Morrow
(74) *Attorney, Agent, or Firm*—Laura N Tunnell; Michael G Petit

(57) ABSTRACT

A patient support system adapted for attachment to the chassis of a vehicle. The vehicle has a cargo bed and a midline bisecting the cargo bed. The assembly includes a chassis mounting portion adapted to be attached to a side wall in the bed of the vehicle, a lateral adjustment mechanism attached to the chassis mounting portion and a litter supporting portion attached to the lateral adjustment mechanism. The assembly permits the litter supporting portion to be positioned near or over the midline of the cargo bed to facilitate the loading of a litter onto the litter supporting portion. After the litter lockingly engages the litter supporting portion, the litter supporting portion can be repositioned laterally with respect to the midline of the vehicle bed. In a preferred embodiment, two assemblies, each of which is a mirror image of the other, are attached to opposing walls in the cargo bed of the vehicle. When the assemblies are moved laterally, a corridor is created between adjacent litters that can be used by an attendant to provide life support.

4 Claims, 7 Drawing Sheets

PATIENT SUPPORT SYSTEM FOR MEDICAL TRANSPORT VEHICLES

BACKGROUND OF THE INVENTION

1. Field of the Invention

The present invention relates to an assembly adapted for mounting in a vehicle, the assembly thereafter being operable for receiving, supporting and manipulating the position of a litter bearing a patient within the vehicle with minimal effort.

2. Prior Art

The medical transport systems currently used to load, handle, and unload patients in military and civilian ambulances involve considerable amounts of manual labor and time. Both the physical exertion of the medical attendants as well as the delay in treatment incurred while loading NATO style litters into a transport vehicle can have a negative affect on the patient. This is particularly significant in the case of ambulances that simultaneously transport several patients, where the physical effort and time associated with loading an occupied stretcher into the vehicle are multiplied by the number of patients to be transported.

While performing certain emergency medical procedures, it is imperative that a caregiver be relaxed, focused, and have sufficient control over his/her muscles to precisely maneuver a variety of instruments. This is especially true for medical attendants aboard moving vehicles who are faced with the added challenge of compensating for the vibrations and unpredictable motions imparted to the caregiver through the vehicle's chassis.

A common lifesaving procedure used to establish an airway for trauma patients who cannot breathe on their own is an endotracheal intubation. As oxygenation of heart and brain tissues is critical to preservation of life, this procedure is often performed at the site of injury or while in an ambulance. Intubation requires a medical attendant to use a laryngoscope to visually and physically guide an endotracheal tube down a patient's throat and into the upper trachea. If the attendant loses mental concentration, or lacks manual dexterity, the tube can be incorrectly placed and fail to supply the patient's lungs with oxygen. Additional procedures such as the detection of a patient's pulse, administration of intravenous fluids, and immobilization of the cervical spine require high degrees of mental and physical coordination. The physical effort associated with the use of currently available stretcher loading systems can cause medical attendants to experience unnecessarily elevated heart rates and muscle fatigue, thereby negatively affecting concentration and fine motor skills. These unwanted mental and physical side effects that result from loading patients into a vehicle can reduce an attendant's ability to perform the necessary lifesaving procedures.

In general, any reduction in the elapsed time between the moment a person sustains a serious injury and his initial receipt of medical care, will improve his chance of survival. Patients suffering from injuries such as, but not limited to, massive hemorrhage, open skull fracture, and tension pneumothorax, must often receive surgical care within an hour of being injured. Accordingly, it is critical that each step of the evacuation and transportation processes be carried out as quickly as possible. As the actions of loading and unloading patients from an ambulance are integral to the emergency medical evacuation process, it is important that they too be conducted rapidly. In the unique case of a military ambulance on an active battlefield, the time required to load patients determines how long medical attendants are exposed as targets to the enemy. In such situations the attendants must be able to load injured patients very rapidly in order to reduce their exposure to enemy fire.

Various litter support assemblies adapted for installation in an ambulance are known in the art. For example, U.S. Pat. No. 4,397,432 discloses an adjustable litter support assembly that includes stanchions with fittings on each stanchion to engage conventional hold-down fixtures on the floor of an aircraft. The stanchions are further supported by interconnectable connecting links carried near the top of each stanchion. Connecting straps also extend from near the top of each stanchion to a floor fitting near the bottom of the other stanchion of each pair. Litter support arms are adjustably connected to each stanchion and carry locking straps for detachably holding a litter thereon.

U.S. Pat. No. 5,738,306 discloses a selectively tiltable patient loading system and transport device adapted for use in aircraft. The device generally comprises a base assembly interconnected to the floor of an aircraft, a platform assembly capable of receiving and supporting a litter with a patient thereon, and an interconnecting assembly interposed between the base assembly and platform assembly for supportably interconnecting the platform assembly to the base assembly and for selectively tilting the platform assembly relative to the base assembly.

Other patents generally addressing assemblies for patient transport include US patents:

| | |
|---|---|
| 2,473,364 | Litter Installation for Vehicles |
| 2,480,322 | Aircraft Ambulance |
| 2,370,402 | Ambulances and Their Equipment |
| 3,358,300 | Mounting and Supporting Apparatus for Litters |
| 3,831,996 | Stretcher Support Arrangement Especially for Ambulances |
| 4,378,128 | Ambulance |
| 5,372,339 | Multi-Tiered Litter Rack System |
| 5,383,629 | Emergency Medical System |
| 5,490,703 | Patient Transport System |
| 5,785,277 | Patient Loading and Transport Device for Aircraft |
| 5,779,296 | Patient Transport System |
| 6,332,638 | Apparatus for Loading Stretchers onto Ambulances |
| 7,047,578 | Modular Patient Support System |

In view of the foregoing discussion it is apparent that it would be beneficial to the victims of domestic terrorist attacks, wartime battles, natural disasters, etc., to provide a vehicle-mounted, patient loading/unloading system that allowed for stretchers to be loaded and unloaded more quickly and with greater ease than what is possible using current systems. A more time-efficient system, that requires less physical effort to operate, is especially advantageous in situations where multiple patients are transported aboard a single ambulance.

SUMMARY

The present invention is an improvement in a patient support system used to load, position, and unload litters from an ambulance for emergency medical service, as well as to physically support the patient and the litter during transport to and from a medical facility. The system described herein is simple to operate, energy efficient, and considerably reduces the time required to load or unload multiple patients from a single ambulance. The invention also provides an onboard medical attendant with a choice of positions in which to securely position patients within the ambulance. The patient support system of the present invention allows medical personnel to quickly and effortlessly load, treat, and unload patients.

The patient support system (PSS) of the present invention includes a mechanical mechanism sometimes referred to as a straight-line mechanism to position and support a plurality of litters within an ambulance. The straight-line mechanism consists of several members pivotally connected to one another at common points so that the members can rotate with respect to each other. Certain points on the mechanism are attached to a fixed member or members which is/are rigidly attached to the chassis of a vehicle. When the mechanism is actuated, one point or points on one of the members travels in a straight line for at least a portion of the travel. This feature is utilized to move the litter inboard and outboard in a horizontal plane within an ambulance, air ambulance, other patient care facilities or non-patient applications. By moving in a horizontal plane the only work performed is that to overcome inertia and friction in the joints of the mechanism.

More particularly, the present invention discloses a laterally adjustable patient support system adapted for attachment to a chassis surface of a substantially rectangular cargo bed of a vehicle. The rectangular cargo bed is bounded laterally by two walls and has a longitudinal midline disposed equidistant from and parallel to the two walls. The patient support system is operable for receiving, supporting and lockingly engaging a litter placed thereon when the patient support system is centrally positioned adjacent the midline. The litter for use with the present assembly includes four supporting feet or "stirrups" projecting downwardly from the lower surface of the litter. After the litter engages the patient support system, the patient support system is operable for enabling the lateral repositioning of the litter away from the midline.

Even more particularly, the patient support system of the present invention comprises: (a) a chassis mounting portion operable for attachment to a portion of the chassis bounding the cargo bed; (b) a litter support portion operable for receiving and engaging a litter placed thereon; and (c) a lateral adjustment portion affixed to both the chassis mounting portion and the litter support portion and disposed therebetween. The lateral adjustment portion supports the litter support portion and is operable for enabling an operator to move the litter support portion laterally and medially with respect to the midline of the cargo bed. The litter support portion comprises two parallel rails that are, in use, parallel to the plane of the cargo bed, each rail having a forward end and a rearward end and a length therebetween. Each of the rails have a C-shaped groove coextensive with the length. Each groove is operable for receiving a stirrup of a litter. Each rail further comprises a stop and a unidirectional lock disposed at the forward end thereof and a bidirectional lock disposed at the rearward end thereof. The unidirectional and bidirectional locks are operable for releasably engaging the stirrup of a litter placed on the rail. In a preferred embodiment, the rearward end of the C-shaped groove in each of the rails is widened to facilitate the placement of a stirrup of a litter within the C-shaped groove. In addition, the litter support portion preferably includes folding means operable for folding the litter support portion of the assembly away from the midline to create space in the cargo bed when the patient support system is not in use. The litter support portion preferably further includes unlocking means operable for disengaging the unidirectional and bidirectional locks from the respectively engaged stirrups on the litter when the litter is to be removed from the assembly.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

In a preferred embodiment of the patient support system of the present invention, a pair of litter support assemblies are attached to the opposing side walls in the cargo bed of a vehicle. For simplicity, only a single support assembly will be described. It will be clear to the artisan that a second assembly, adapted for attachment to an opposing side wall in the cargo bed, is a mirror image of the first assembly described below.

Figure 1:
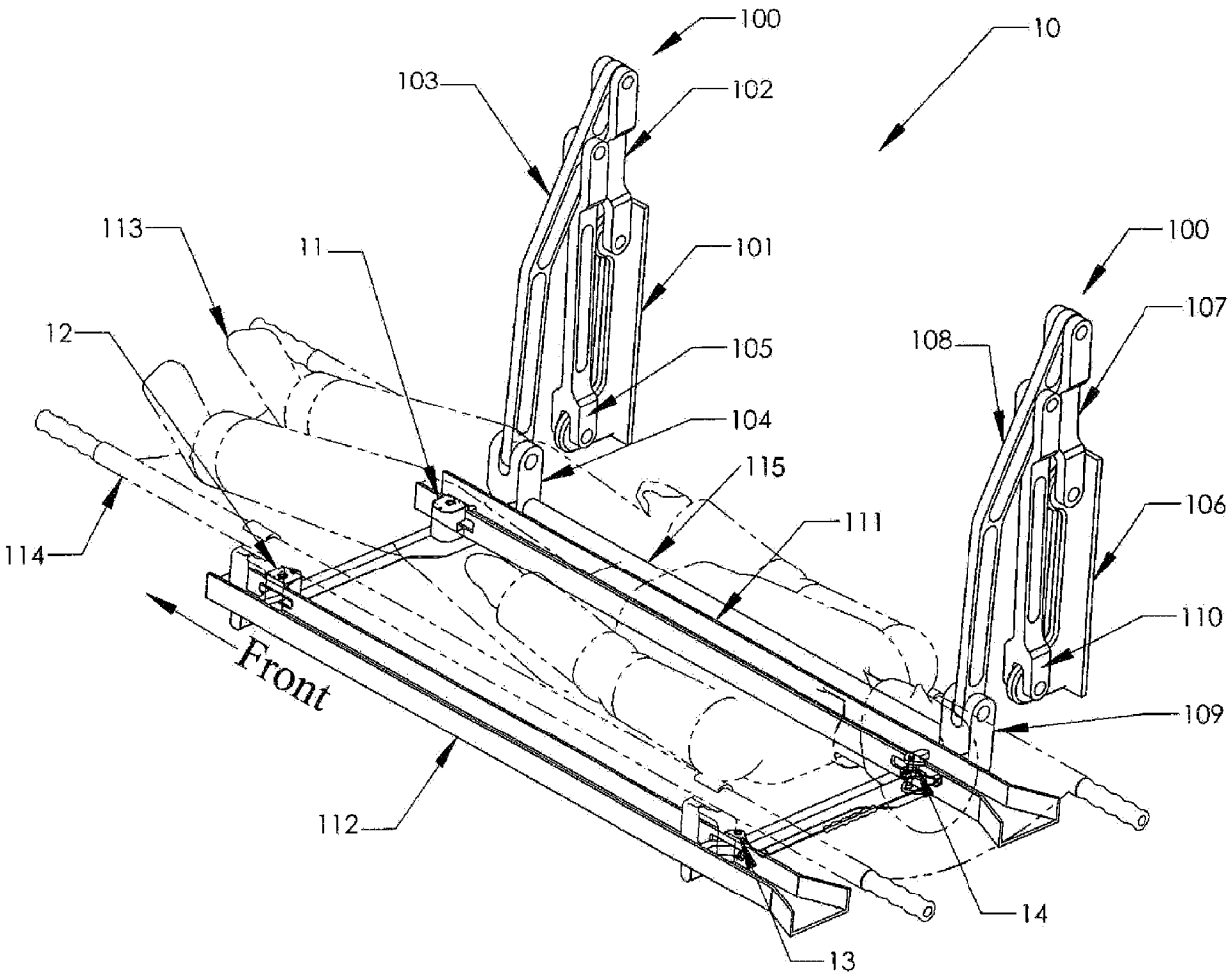
FIG. 1 is a perspective view of a vehicle-mountable patient support system (PSS) for supporting and manipulating the position of a litter within a vehicle in accordance with a preferred embodiment of the present invention. The PSS is illustrated in an contracted lateral position.
Figure 2:
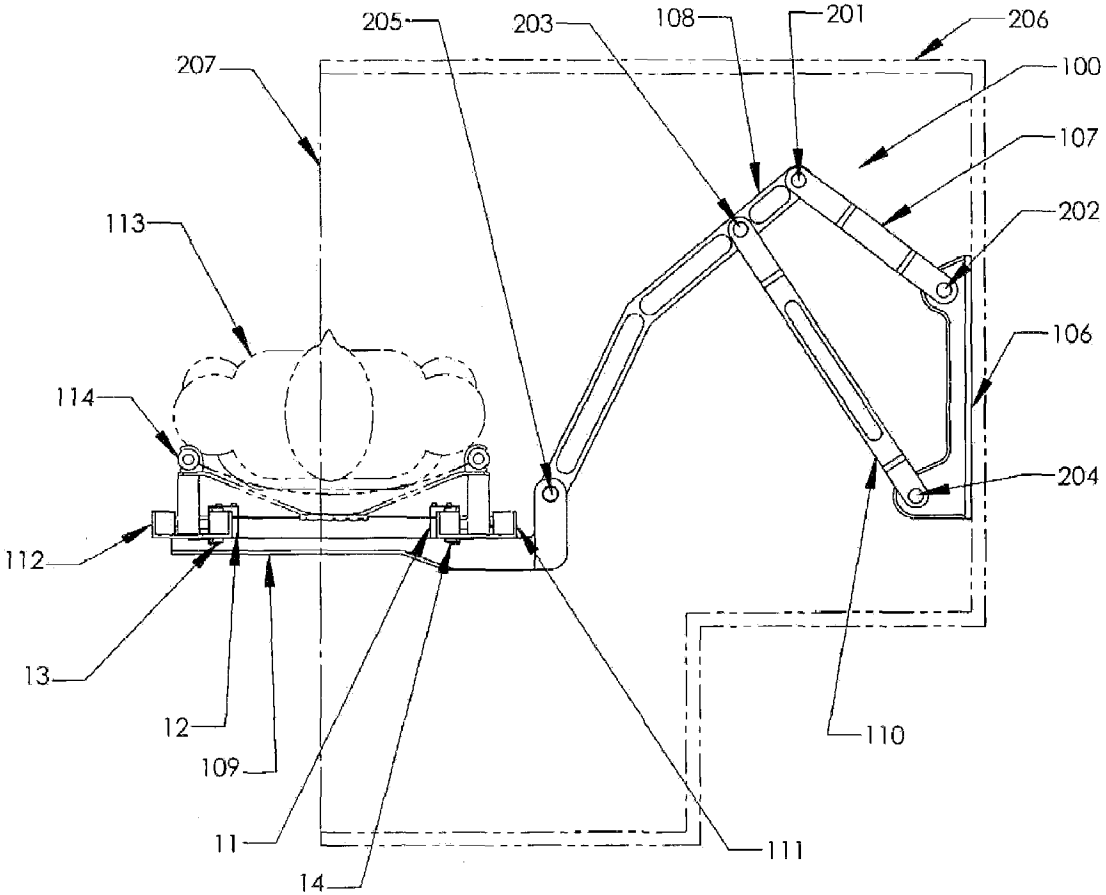
FIG. 2 is a rear end view of the vehicle-mountable patient support system of FIG. 1. The PSS is shown in an extended medial position used to load the litter onto the PSS.

With reference to FIGS. 1 and 2, a litter support system 10 in accordance with the present invention comprises front 101 and rear 106 chassis mounting portions adapted to be attached to a side wall 206 (FIG. 2) in the bed of a vehicle (not shown), front and rear lateral adjustment portions 100 attached to the respective front and rear chassis mounting portions 1001 and 106 and a rectangular litter supporting portion comprising "C-channel" rails 111 and 112 attached to, and, in turn, supported by, members 104 and 109 of the lateral adjustment portion 100.

The front and rear lateral adjustment portions 100 are identical and are sometimes referred to in the art as "straight-line" mechanisms. Since the front and rear lateral adjustment portions 100 are identical, only one needs description. The rear straight-line mechanism 100 includes members 106, 107, 108, 109, and 110, shown in a collapsed or laterally contracted configuration in FIG. 1, and a fully extended configuration in FIG. 2. FIG. 2 also shows a simplified vehicle interior wall layout 206 and vehicle centerline 207 indicated by dashed lines. The patient 113 and litter 114, shown in phantom in FIG. 2, are positioned at the approximate position of maximum extension of the lateral adjustment portions 100. The wall mounts 101 and 106 are attached to the wall 206 or other support structure and are provided with pivotal attachment means 202, 204 (FIG. 2) for pivotally attaching member 110 of the lateral adjustment portion 100 to the rear chassis attachment portion 106. The individual members 107, 110, 108, and 109 comprising the rear lateral adjustment portion 100 incorporate pivots at points 201, 202, 203, 204, and 205. The patient 113, supported by a litter can be loaded onto the litter support system 10 with the rails 111 and 112 of litter support portion of the assembly 10 positioned in a medial, litter-loading position shown in FIG. 2 for optimum access and clearance with the vehicle's (ambulance's) rear doorway.

Figure 3:
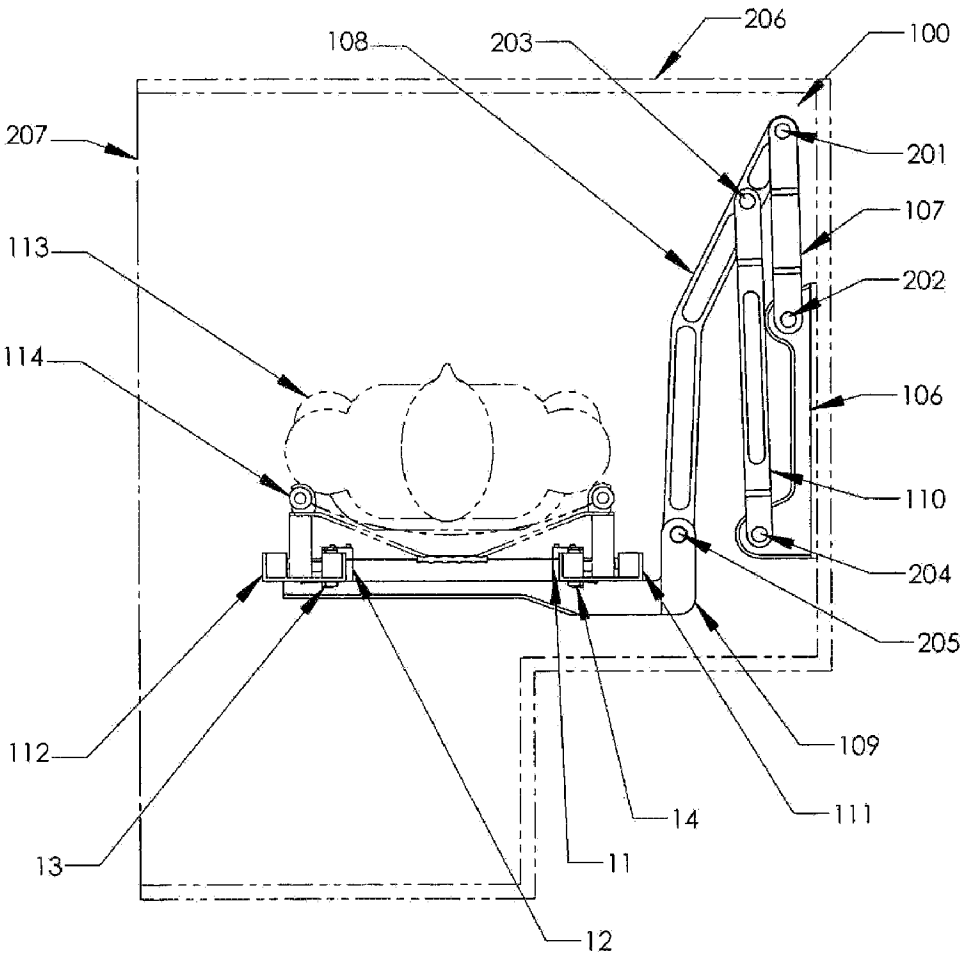
FIG. 3 is a rear end view of the vehicle-mountable patient support system of FIGS. 1 and 2. The PSS is shown in a contracted lateral position used to transport the patient after the litter has been loaded onto the PSS.

When a laterally-directed horizontal force is applied to the left C-Channel rail 112, the litter support portion (comprising support member 109 and rails 111 and 112) moves laterally (i.e., toward the right) until a stop is reached. The stop can be incorporated into the mechanism 100 or be a part of the non-movable structure. The assembly 10 is then in the transport position as shown in FIG. 3. Stops are provided in the mechanism so that it can be locked and held firmly in any number of positions desired between the loading position shown in FIG. 2 to the transport position shown in FIG. 3. By attaching the assembly 10 to the wall 206 of the vehicle bed, floor space is freed up for storage of medical equipment or supplies and an attendant.

Two identical mechanisms 100, one front and one rear as described above, are required in order to provide a stable litter support system 10 as shown in FIG. 1. The distance between the two support mechanisms would normally be approximately the same as the distance between the stirrups on a NATO-style litter but can be positioned as driven by other requirements. Stability of the two mechanisms in a direction parallel to the wall that the two litter support systems are mounted on can be accomplished by several means. For example, a structural member such as a torque tube 115 (FIG. 1) can be interposed to connect a common point on members 104 and 109 of each mechanism 100 to provide the desired lateral stability.

Figure 5:
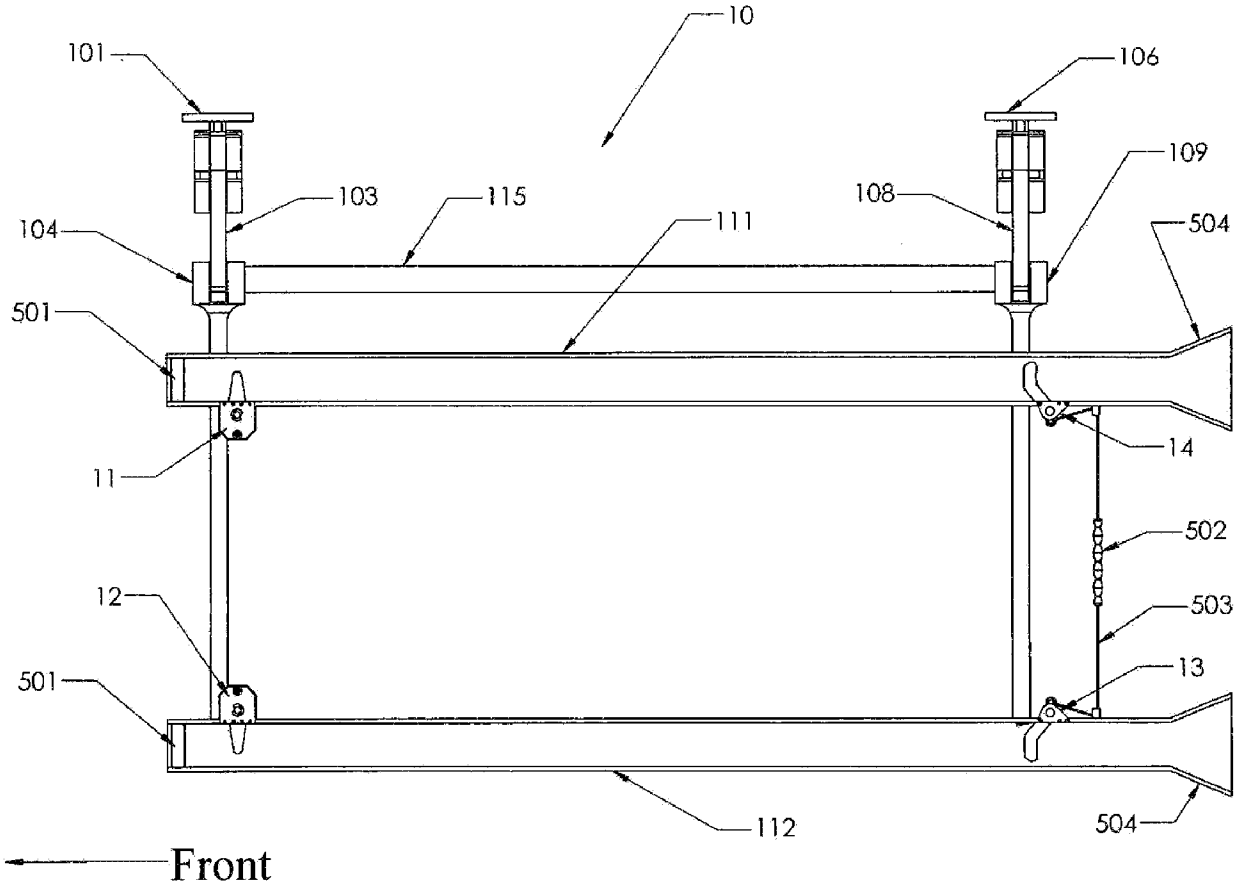
FIG. 5 is a top view of the PSS of FIGS. 1-4 illustrating the litter lock mechanism disposed on the litter support rails.

The two C-channel members identified in FIG. 1 as members 111 and 112 are attached to members 104 and 109. These two members 104, 109 support rails 111 and 112 which facilitate loading the patient into the litter support system 10 as well as restraining the litter during transport. When loading a litter, the stirrups on the forward end of the litter are inserted into and supported by the rearward end of the two C-channels 111, 112. The litter is then slid forward within the C-channels until the second rear litter stirrups are slid onto and supported by the C-channels (i.e., rails) 111, 112. The litter is then further advanced along the rails until it is prevented from moving further by stops 501 disposed within the C-channel of the rails 111 and 112 at the forward end thereof as shown in FIG. 5. The stirrups on the litter are then automatically locked into place preventing motion of the litter relative to the litter support portion in any direction. When unloading the litter, the stirrup locks are released and the procedure is reversed. The rearward ends of the supporting C-channels in rails 111 and 112 are preferably widened 504 at the rearward ends thereof where the litter stirrups are first inserted to facilitate ease of insertion. The release control for the locks for the litter support stirrups as well as the inboard outboard translation position are placed in a convenient location for the operator. The two C-channel rails 111 and 112 can be attached to support members 104 and 109 by a quick disconnect device that requires no tools to connect or disconnect.

Figure 4:
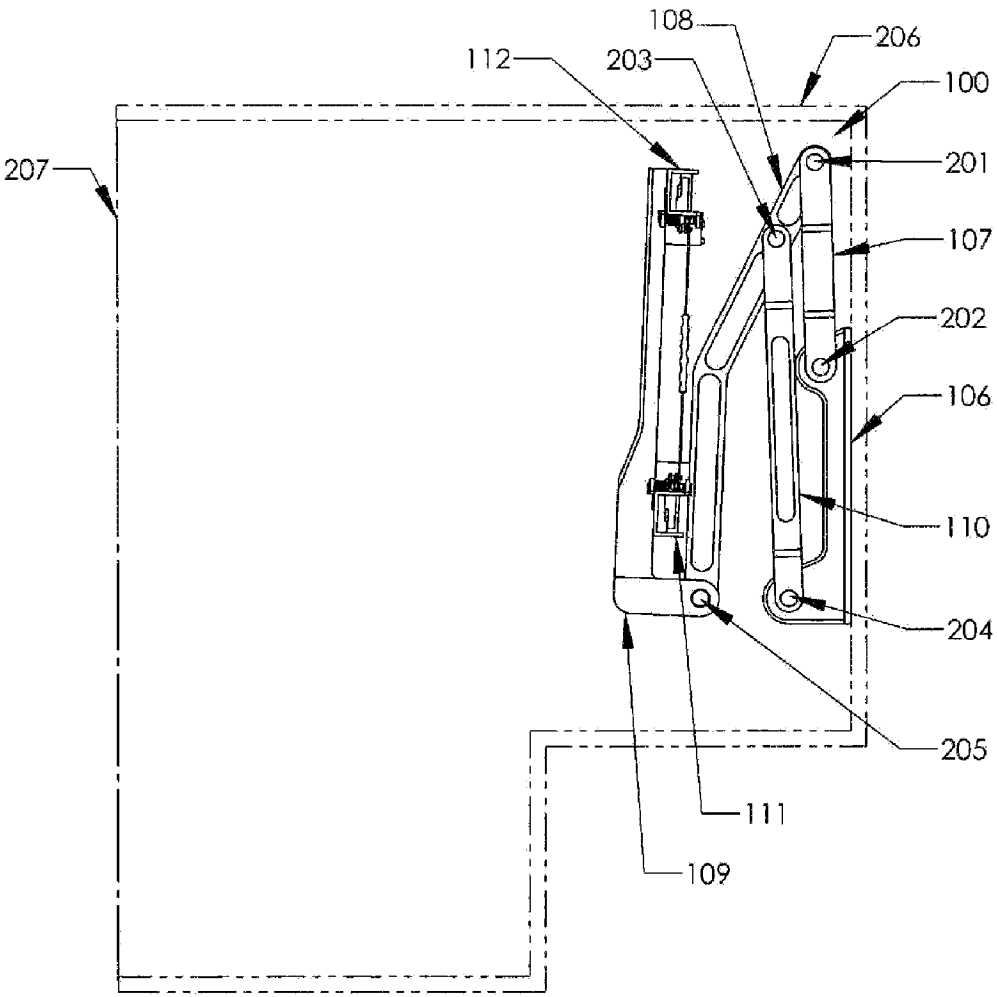
FIG. 4 is a rear end view of the vehicle-mountable patient support system of FIGS. 1-3 wherein the portion of the PSS that supports the litter is folded upward when not in use.

Referring now to FIG. 4, when the litter support assembly 10 is not being used, both C-channels 111 and 112 can be removed from the support members 104 and 109. More preferably, support members 104 and 109 (only litter support member 109 is shown in FIG. 4) are pivoted upward about point 205 for storage. After the assembly is folded into a stowed position as shown in FIG. 4, member 109 can be restrained from unwanted rotation with respect to member 108 by a detent assembly disposed on member 109 and 108, the detent assembly being operable for the releasable engagement of respective members and restraint of rotation of member 109 with respect to member 108.

FIG. 5 is a top view of the patient support system 10 generally illustrating the automatic locking system used to secure a litter to the assembly 10. The litter locking system consists of four spring loaded lock mechanisms 11, 12, 13, 14 and two permanent stops 501. NATO-style litters generally have four supporting feet or stirrups disposed on, and projecting downwardly from, the lower surface thereof. Each of the four locks is positioned to engage one of the four stirrups on the underside of the litter. More specifically, each of the C-channels 111 and 112 is fitted with one unidirectional lock 11, 12 at the forward end thereof, and one bidirectional lock 13, 14 at the rear end thereof in order to engage and restrain the forward and rearward stirrups respectively. The spacing between the locks 12 and 13 and between locks 11 and 14 is approximately equal to the longitudinal spacing between the stirrups of a NATO-style litter. Once engaged, the locks 11, 12, 13, 14 prevent the litter from moving upward or rearward with respect to the cargo bed. Forward motion is prevented by the permanent stops 501 disposed at the forward end of the C-channels. In order to remove a litter from the support system 10, the bidirectional locks 13, 14 must be manually disengaged.

The locking system incorporates two types of lock mechanisms. The bidirectional locks 13 and 14 restrain motion of a litter stirrup in both the upward and rearward directions, while the unidirectional locks 11 and 12 prevent upward motion only. FIG. 5 depicts the bidirectional locks 13 and 14 disposed at the rearward end of the C-channels 111 and 112, and the unidirectional locks 11 and 12 disposed at the forward end of the C-Channels 111 and 112. The system is designed to be operated from the rearward end of the support system 10 where the bidirectional locks 13 and 14 are attached. If it is necessary to operate the locks 13 and 14 from the front end of the support system 10, this configuration can be reversed. Once the stirrups are fully engaged by the respective locks, the locks 11, 12, 13, 14, together with the permanent stops 501, prevent any motion of the litter with respect to the support system 10.

Figure 6:
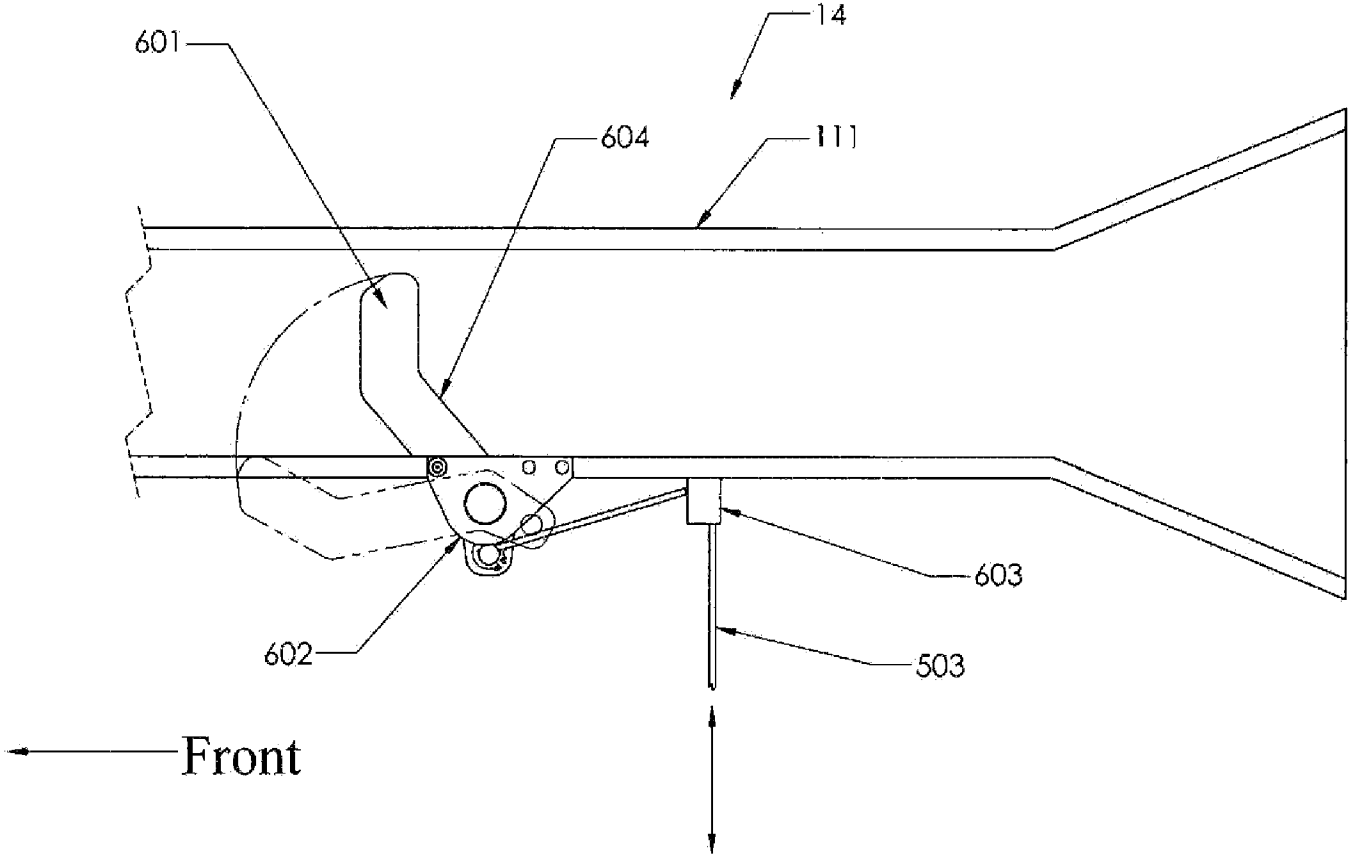
FIG. 6 is a top detail view of one of the two bidirectional litter locking mechanism of the PSS illustrating the action of litter locking mechanism disposed on the litter support rails when a litter is placed on the rails and advanced to a forwardmost position.

A top view of the right, rear bidirectional lock 14 is shown in FIG. 6. It is clear to the artisan that the left rear bidirectional lock 13 is a mirror image of the lock 14. From its default position (shown in solid lines), the lever 601 is limited to rotation in the counterclockwise direction as indicated by the dashed arc. The lever 601 is shaped in such a way as to both maximize the surface area that contacts the vertical face of the litter stirrup, and minimize the size of the required cutout in the side of the C-channel 111 through which cutout the lever 601 extends into the C-channel. As a litter stirrup (not shown) approaches the lever 601 from the right, it first contacts the angled face 604, and rotates the (spring-loaded) lever 601 in a counterclockwise direction completely out of the path of the stirrup. Once the leading edge of the stirrup has passed the tip of the lever, a spring mechanism 602 returns the lever, to its locked position. When the lever returns to occupy a cutout in the stirrup, the stirrup is prevented from moving either upward or rearward. When the litter is to be removed from the litter support assembly 10, bidirectional locks 13 and 14 are disengaged from the stirrup by pulling (or pushing) on the release cord hand grip 502, shown in FIG. 5 which applies tension to the release cord or cable 503 around the pivot wheel or pulley 603 causing a counterclockwise rotation of the lever 601. The lever disengages the litter stirrup as it is withdrawn from the center of the C-channel 111. Because the release cable 503 is also connected to the bidirectional lock 13 on the adjacent C-Channel 112, the locks 13 and 14 will simultaneously disengage and release their respective litter stirrups. The lever drawn in phantom lines represents this fully open (disengaged) position of lever 601 when tension is applied to the cable 503. Once the litter has been removed, the release cord hand grip 502 is released, and the spring mechanism 602, returns the lever to its default position.

Figure 7:
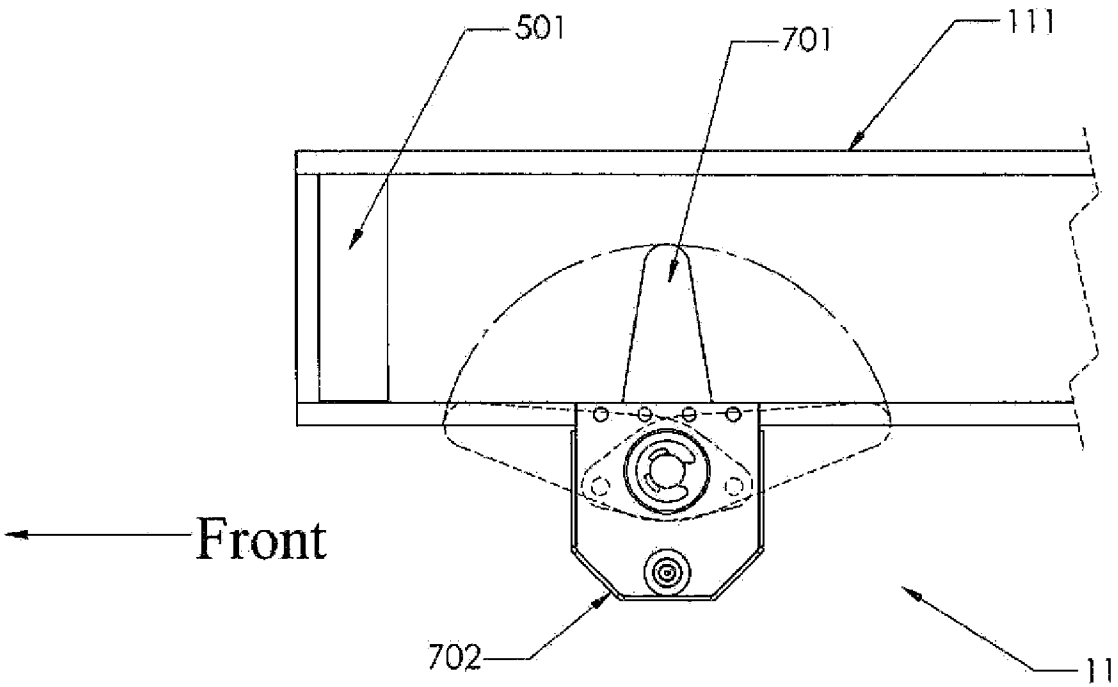
FIG. 7 is a top detail view of one of the two unidirectional litter locking mechanism of the PSS illustrating the action of litter locking mechanism disposed on the litter support rails when a litter is placed on the rails and advanced to a forwardmost position.

A top view of a forwardly disposed unidirectional lock 11 is shown in FIG. 7. Unidirectional locks 11 and 12 are affixed to the outer wall of the forward ends of the C-channels 111 and 112 and are identical. The lock 11 comprises a spring-loaded lever 701 that projects into the C-channel in rail 111 through a cutout as shown. From the default position (shown in solid lines), the lever 701, is free to rotate in both clockwise and counterclockwise directions when urged to do so by an applied force. As a litter stirrup approaches the lever 701, it applies a force that urges the lever to rotate in a counterclockwise direction. Once the leading edge of the stirrup has passed the tip of the lever 701, a spring mechanism 702 returns the lever 701 to its default position. With the lever positioned within a slot in the stirrup, the stirrup will be prevented from moving upward. The lock is disengaged by pulling the litter rearward until the stirrup has rotated the lever 701 completely out of the C-channel in the clockwise direction.

Although a straight-line mechanism is described herein as comprising the lateral adjustment portion 100, the present disclosure contemplates the use of similar mechanisms for the lateral adjustment portion 100 that perform the same function. One example is an arrangement of telescoping square tubes. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A laterally adjustable litter support assembly adapted for attachment to a chassis surface of a substantially rectangular cargo bed of a vehicle wherein said cargo bed is bounded laterally by two walls and wherein said cargo bed has a longitudinal midline disposed equidistant from and parallel to said two walls, said litter support assembly being operable for receiving, supporting and lockingly engaging a litter placed thereon when said litter support assembly is positioned adjacent said midline and wherein after said litter engages said litter support assembly, said litter support assembly is operable for enabling the lateral repositioning of said litter away from said midline and wherein said litter support assembly comprises: (a) a chassis mounting portion operable for attachment to a wall of said cargo bed; (b) a litter support portion operable for receiving and engaging a litter placed thereon; and (c) a lateral adjustment portion affixed to said chassis mounting portion and said litter support portion and disposed therebetween wherein said lateral adjustment portion supports said litter support portion and is operable for enabling an operator to move said litter support portion laterally and medially with respect to said midline and wherein said litter support portion comprises two parallel rails having a forward end and a rearward end and a length therebetween and wherein each of said rails have a C-shaped groove coextensive with said length, said groove being operable for receiving a stirrup of a litter and wherein said rails further comprise a stop and a bidirectional lock disposed at the forward end thereof and a unidirectional lock disposed at the rearward end thereof wherein said unidirectional lock and said bidirectional locks are operable for releasably engaging a stirrup of a litter placed on said rail.

2. The litter support assembly of claim 1 wherein said rearward end of said C-shaped groove in each of said rails is widened to facilitate the placement of a stirrup of a litter within said C-shaped groove.

3. The litter support assembly of claim 1 wherein said litter support portion includes folding means operable for folding said litter support portion away from said midline.

4. The litter support assembly of claim 1 further comprising unlocking means operable for disengaging said unidirectional and bidirectional locks from stirrups on a litter.

* * * * *